US008426493B2

(12) United States Patent
Showman et al.

(10) Patent No.: US 8,426,493 B2
(45) Date of Patent: Apr. 23, 2013

(54) FOUNDRY MIXES CONTAINING SULFATE AND/OR NITRATE SALTS AND THEIR USES

(75) Inventors: Ralph E. Showman, Galloway, OH (US); Sean B. Harmon, Columbus, OH (US)

(73) Assignee: ASK Chemicals L.P., Wilmington, DE (US)

( * ) Notice: Subject to any disclaimer, the term of this patent is extended or adjusted under 35 U.S.C. 154(b) by 65 days.

(21) Appl. No.: 12/873,803

(22) Filed: Sep. 1, 2010

(65) Prior Publication Data

US 2011/0139310 A1 Jun. 16, 2011

Related U.S. Application Data

(60) Provisional application No. 61/286,913, filed on Dec. 16, 2009.

(51) Int. Cl.
*B22C 1/00* (2006.01)

(52) U.S. Cl.
USPC ..... 523/139; 148/400; 106/38.9; 106/38.3; 106/38.35; 523/143; 523/148; 164/44; 164/131

(58) Field of Classification Search ..... 523/139
See application file for complete search history.

(56) References Cited

U.S. PATENT DOCUMENTS

| | | | | |
|---|---|---|---|---|
| 3,379,540 | A | 4/1968 | Helliwell | |
| 3,409,579 | A | 11/1968 | Robins | |
| 3,485,797 | A | 12/1969 | Robins | |
| 3,804,641 | A * | 4/1974 | Lyass et al. | 106/38.2 |
| 4,020,027 | A * | 4/1977 | Nicholas et al. | 523/147 |
| 4,284,121 | A | 8/1981 | Horton | |
| 4,391,642 | A | 7/1983 | Stevenson | |
| 4,526,219 | A | 7/1985 | Dunnavant | |
| 4,750,716 | A | 6/1988 | Reeve-Parker | |
| 4,985,489 | A | 1/1991 | Barker | |
| 5,646,199 | A | 7/1997 | Yoshida | |
| 6,598,654 | B2 | 7/2003 | Prat Urreiztieta | |
| 7,938,169 | B2 | 5/2011 | Attridge | |
| 2003/0155098 | A1 | 8/2003 | Brown | |
| 2005/0087323 | A1 * | 4/2005 | Hathaway | 164/522 |
| 2005/0155741 | A1 * | 7/2005 | Baker et al. | 164/529 |

* cited by examiner

*Primary Examiner* — Doris Lee
(74) *Attorney, Agent, or Firm* — Standley Law Group LLP

(57) ABSTRACT

Disclosed is a foundry mix containing a sulfate and/or nitrate salt and its use to make foundry shapes by the warm-box, hot-box, no-bake, and cold-box process, the use of these foundry shapes to make metal castings, and the metal castings prepared by the process.

20 Claims, No Drawings

FOUNDRY MIXES CONTAINING SULFATE AND/OR NITRATE SALTS AND THEIR USES

CROSS REFERENCE TO RELATED APPLICATIONS

This application claims the benefit of priority to U.S. Provisional Patent Application Ser. No. 61/286,913 filed Dec. 16, 2009 as if fully incorporated herein.

BACKGROUND

Silica sand ($SiO_2$, quartz) is widely used as an aggregate in the metal casting industry for the production of molds and cores. It is used for both "greensand" (sand bonded with water and clay) and for chemically bonded sand. A variety of inorganic and organic chemical binders are used including phenolic urethane, furan, epoxy-acrylic, and ester-cured phenolic.

The binders are mixed with the sand and the mixture is compacted in tooling to take the shape of the desired mold or core, then the binder hardens and bonds the sand grains together. The mold and core components are then assembled into a mold package and metal is poured into the package and fills the internal cavities in the shape of the desired casting. The heat from the liquid metal, especially in the case of ferrous alloys with melting points in excess of 1100° C., starts to decompose the binder and heat the sand. As the silica sand heats, thermal expansion occurs. This expansion is relatively linear until the temperature reaches approximately 570° C. when the crystal structure of the sand grains transforms. This structural transformation is accompanied by rapid isothermal expansion followed by a period of thermal shrinkage up to around 980° C. when another crystal structure change occurs with more thermal expansion.

It is believed that these rapid volumetric changes in the sand grains develop mechanical stresses in the layers of sand near the casting surface that can lead to cracking of the mold or core surface which is in contact with the hot molten liquid metal in the mold. The molten liquid metal can flow into these cracks and form veins or fins on the casting surface. These are undesirable and require time and effort to remove. In critical applications with small internal cored passageways, the vein can extend across and block the passageway. Examples of these critical castings are engine blocks and heads with water jackets that could be blocked by the veins in locations that are difficult to detect and even more difficult to remove.

Other types of aggregates can also be used to produce "sand" molds and cores including naturally occurring zircon, chromite, olivine, and man-made ceramic and other aggregates. These have lower expansion rates with no phase changes and a much reduced tendency to form veining defects, but are also much more expensive.

Sand additives have been used with silica sand to reduce the veining tendency. These sand additives typically fall into three main categories based on their mechanism of activity.

The first category consists of "low expansion aggregates" such as a 90:10 mix of silica and zircon sand, which has a lower expansion value than silica alone. In addition to the naturally occurring aggregates, man-made aggregates like ceramic (mullite) beads, aluminum-silicate "microspheres", or fused silica can be used.

The second category consists of "organic cushioning materials" such as wood flour, dextrin and starch. When mixed with the silica sand, they occupy some volume between the sand grains. Thus, when molten metal is poured into the mold, the heat from the molten metal quickly burns out the extra organic material. The volume previously occupied by the organic material can then provide a "cushion" or space for the expansion of the sand, thus reducing the buildup of stresses in the sand.

The third category of sand additives consists of "fluxes" that react with the surface of the sand grains to chemically change the surface layer of the sand and the resulting expansion characteristics of the sand. Examples of such fluxes are iron oxides, both hematite ($Fe_2O_3$) and magnetite ($Fe_3O_4$), which have long been used as sand additives. Other flux-type sand additives include titanium oxide ($TiO_2$) and lithia ($Li_2O$) containing materials such as spodumene. It has also been demonstrated that the use of a combination of several different flux type additives may have a beneficial effect. This is particularly true when hematite is used with other additives.

The existing categories of sand additives can reduce veining in castings, but all three categories of sand additive have some important disadvantages. The low expansion aggregates tend to be expensive compared to silica sand and need to be used at relatively high levels (greater than 10 percent based on sand). The organic cushioning materials tend to add to the total amount of gas produced by the mold or core when exposed to liquid metal and can significantly reduce mold/core strength when used at levels above about 1 percent. The flux-type sand additives are currently the most widely used additives, but they also have some drawbacks. For instance, iron oxides, when used above about 2 percent by weight based on the sand (BOS) can cause increased metal penetration and can reduce mold/core strength when used at higher levels. The lithia bearing spodumenes are expensive and typically are used in higher levels, e.g. 4-8 percent by weight based on the sand (BOS).

SUMMARY

The disclosure describes a foundry mix comprising an aggregate and certain sulfate and/or nitrate salts. The sulfate and/or nitrate salts can be used in amounts of less than 4.0 weight percent based upon the weight of the aggregate, and even in amounts of 1.0 weight percent and less, to effectively reduce the veining of a metal casting prepared with the foundry mix. It also describes the use of the foundry mix to make foundry shapes by the warm-box, hot-box, no-bake, and cold-box process, the use of these foundry shapes to make metal castings, and the metal castings prepared by the process. When the foundry mix is used, veining is reduced or eliminated in metal castings made from the foundry shapes that are used to cast metal parts.

It was surprising that sulfate salts could be used in the foundry mix to improve veining because it is known that these compounds are thermally stable at the high temperatures associated with molten metal, so it was unexpected that they would break down to form fluxing agents. The unexpected thermal breakdown provides a two-fold benefit. The initial break down is accompanied by a volume reduction and the release of a gas which permeates out of the mold/core. This may provide a "cushioning" effect similar to the organic sand additives. The breakdown products are then active to provide a fluxing effect similar to lithia-containing compounds and similar additives. It was surprising that the nitrate salts could be used in the foundry mix to improve veining because it is known that these compounds are strong oxidizers and could react violently at metal casting temperatures.

DETAILED DISCLOSURE

The sulfate and/or nitrate salts that are used as the sand additive of the foundry mix include sulfate and/or nitrates such as sodium sulfate, potassium sulfate, calcium sulfate, magnesium sulfate, sodium nitrate, potassium nitrate, calcium nitrate, and magnesium nitrate, and mixtures thereof. Pure sulfate and/or nitrate salts and/or naturally occurring minerals containing sulfate and/or nitrate salts can be used. An example of a naturally occurring mineral that contains sulfate salts is gypsum and an example of a naturally occurring nitrate is saltpeter. Gypsum offers advantages as a source of sulfate and/or nitrate salts because of its availability and price.

The amount of sulfate and/or nitrate salt used in the foundry mix is an amount effective to reduce or eliminate veining in the metal castings made with foundry shapes (e.g. molds and cores) used to cast metal parts. An effective amount of the sulfate and/or nitrate salt typically is from 0.25 percent by weight to 5.0 percent by weight based upon the weight of the foundry aggregate, preferably from 0.5 percent by weight to 3.0 percent by weight based upon the weight of the foundry aggregate, and most preferably from 0.75 percent by weight to 2.0 percent by weight based upon the weight of the foundry aggregate.

In addition to sulfate and/or nitrate salts, the foundry mix may also contain known sand additives such as red iron oxide, black iron oxide, and lithia-containing compounds. It is particularly useful to use red iron oxide in conjunction with the sulfate and/or nitrate salt. If red iron oxide is used with a sulfate and/or nitrate salt, it is typically used in a weight ratio of sulfate and/or nitrate salt to red iron oxide from 1:1 to 5:1, preferably from 2:1 to 4:1.

The foundry mix may also contain a foundry binder. These foundry binders are well-known in the art. Any inorganic or organic warm-box, hot-box, no-bake or cold-box binder can be used if it will sufficiently hold the foundry shape together and polymerize in the presence of a curing catalyst. Examples of such binders are phenolic resins, phenolic urethane binders, furan binders, alkaline phenolic resole binders, and epoxy-acrylic binders among others. Particularly preferred are phenolic urethane binders and epoxy-acrylic binders. The phenolic urethane binders are described in U.S. Pat. Nos. 3,485,497 and 3,409,579, which are hereby incorporated into this disclosure by reference. These binders are based on a two part system, one part being a phenolic resin component and the other part being a polyisocyanate component. The epoxy-acrylic binders cured with sulfur dioxide in the presence of an oxidizing agent are described in U.S. Pat. No. 4,526,219 which is hereby incorporated into this disclosure by reference.

The amount of binder needed is an effective amount to maintain the shape and allow for effective curing, i.e. which will produce a foundry shape which can be handled or self-supported after curing. An effective amount of binder is typically greater than about 0.1 percent by weight, based upon the weight of the foundry aggregate. Preferably the amount of binder ranges from about 0.5 percent by weight to about 5 percent by weight, more preferably from about 0.5 to about 2 percent by weight.

Curing the foundry mix by the no-bake process takes place by mixing a liquid curing catalyst with the foundry mix (alternatively by mixing the liquid curing catalyst with the foundry mix first), shaping the foundry mix containing the catalyst, and allowing the shaped foundry mix to cure, typically at ambient temperature without the addition of heat. The warm-box and hot-box processes are similar to the no-bake process, except the tooling and/or the foundry shape is heated in order to facilitate curing. The preferred liquid curing catalyst is a tertiary amine for the no bake process and is described in U.S. Pat. No. 3,485,797 which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine. If a furan binder is used in a warm-box, hot-box, or no-bake process, the curing catalyst typically used is an inorganic or organic acid, e.g. strong acids such as toluene sulfonic acid, xylene sulfonic acid, benzene sulfonic acid, HCl, and $H_2SO_4$. Weak acid such as phosphoric acid can also be used.

Curing the foundry shape by the cold-box process takes place by blowing or ramming the foundry mix into a pattern and contacting the foundry shape with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resin.

See U.S. Pat. No. 4,526,219 which is hereby incorporated into this disclosure by reference. Carbon dioxide (see U.S. Pat. No. 4,985,489 which is hereby incorporated into this disclosure by reference) or methyl esters (see U.S. Pat. No. 4,750,716 which is hereby incorporated into this disclosure by reference) are used with alkaline phenolic resole resins. Carbon dioxide is also used with binders based on silicates. See U.S. Pat. No. 4,391,642 which is hereby incorporated into this disclosure by reference.

Preferably the binder is a cold-box phenolic urethane binder cured by passing a tertiary amine gas, such a triethylamine, through the molded foundry mix in the manner as described in U.S. Pat. No. 3,409,579, or the epoxy-acrylic binder cured with sulfur dioxide in the presence of an oxidizing agent as described in U.S. Pat. No. 4,526,219.

It will be apparent to those skilled in the art that other additives such as release agents, solvents, bench life extenders, silicone compounds, etc. may be added to the foundry mix.

EXAMPLES

In Example A (comparison example) and Examples 1-2, test cores (2" diameter by 2" high cylindrical cores) were produced by the warm-box process by mixing Badger 5574 silica sand with CHEM-REZ® 995 furan binder (commercially available from Ashland Inc.) at 1.25 percent BOS, 20 percent BOB (based on binders) of CHEM-REZ FC521 catalyst (commercially available from Ashland Inc.), and the sand additive and amount (based on the weight of the sand, BOS) shown in Table 1, and blowing the mix into the corebox which was maintained at about 235° C.

In Example B (comparison example) and Examples 3-5, the test cores were prepared by the cold-box process by mixing Wedron 540 silica sand with ISOCURE® TKW 10/20 phenolic urethane binder (a two-part phenolic urethane binder commercially available from Ashland Inc. where the ratio of the Part I to Part II is 1:1) at 1.0 percent and in Table 1, blowing the mix into a corebox with 2" cylindrical by 2" high cavities and curing the cores with TEA catalyst.

The veining characteristics of the test cores were measured using a "penetration" test casting in which the test cores are glued into a mold assembly. Molten Class 30 grey iron, having a temperature of approximately 1450° C., is then poured into the mold assembly containing the test cores. The penetration tests for veining and mechanical penetration are described by Tordoff and Tenaglia in AFS Transactions, pp. 149-158 (AFS 84th Annual meeting, St. Louis, Mo., Apr.

21-25, 1980). Surface defects were determined by visual observation and the rating of the casting was based upon experience and photographs of the test castings.

The casting is cooled and cleaned by sand blasting and the internal surfaces of the cavity created by the cores are evaluated and compared visually for veining and rated on a scale of 1 to 5, where 5 represents the worst veining and 1 showing no veining. The results are set forth in Table 1 that follows.

TABLE 1

(Veining characteristics of test cores)

| Example | Additive | Total amount of anti-veining additive (BOS) | Veining (rating) |
|---|---|---|---|
| A (warmbox) | None | none | 4.0 |
| 1 (warmbox) | Sodium sulfate | 1 percent total [2] | 1.5 |
| 2 (warmbox) | Potassium sulfate | 1 percent total [2] | 1.0 |
| B (cold-box) | none | None | 3.0 |
| 3 (cold-box) | calcium sulfate | 1 percent total [2] | 1.0 |
| 4 (cold-box) | sodium nitrate | 1 percent total [3] | 1.0 |
| 5 (cold-box) | potassium nitrate | 1 percent total [3] | 1.0 |

[1] no iron oxide addition
[2] 0.5 percent iron oxide also added to control penetration
[3] 1 percent iron oxide also added to control penetration The data in Table 1 clearly indicate that the test cores prepared with a foundry mix containing a sulfate and/or nitrate salt reduce veining in the test casting, even at levels as low as 1.0 weight percent BOS.

The disclosure and examples are capable of various combinations, modifications, and adjustments to the parameters which are within the scope of the claims, so the claims should be construed to include alternative embodiments.

The invention claimed is:

1. A foundry mix comprising:
foundry aggregate;
an organic binder;
an inorganic salt selected from the group consisting of sodium, potassium, calcium and magnesium sulfate salts, nitrate salts, and mixtures thereof in an amount to reduce the veining of a metal casting prepared with the foundry mix; and
an iron oxide selected from the group consisting of red iron oxide, black iron oxide, and mixtures thereof, the weight ratio of sulfate and/or nitrate salt to red iron oxide is from 1:1 to 2:1.

2. The foundry mix of claim 1 wherein the foundry mix also contains dolomite.

3. The foundry mix of claim 1 wherein the iron oxide is red iron oxide.

4. The foundry mix of claim 3 wherein the foundry aggregate comprises silica sand.

5. The foundry mix of claim 4 wherein the inorganic salt is selected from the group consisting of sodium, potassium, calcium and magnesium sulfate, and mixtures thereof.

6. A foundry mix of claim 4 wherein the salt is selected from the group consisting of sodium, potassium, calcium and magnesium nitrate and mixtures thereof.

7. The foundry mix of claim 5 wherein gypsum is used in the foundry mix as the source for the calcium sulfate salt.

8. The foundry mix of claim 5, 7, or 6 wherein the weight ratio of sulfate and/or nitrate salt to red iron oxide is from 1:1 to 4:1.

9. The foundry mix of claim 1 wherein the binder is selected from the group consisting of: phenolic binders, phenolic urethane binders, furanic binders and epoxy acrylate binders.

10. The foundry mix of claim 9 wherein the amount of salt in the foundry mix is from 0.5 percent by weight to 4.0 percent by weight based upon the weight of the foundry aggregate.

11. The foundry mix of claim 9 wherein the amount of salt in the foundry mix is from 0.5 percent by weight to 2.5 percent by weight based upon the weight of the foundry aggregate.

12. The foundry mix of claim 1 wherein the foundry mix contains a catalyst.

13. The foundry mix of claim 12 wherein the amount of salt in the foundry mix is from 0.5 percent by weight to 4.0 percent by weight based upon the weight of the foundry aggregate.

14. The foundry mix of claim 12 wherein the amount of salt in the foundry mix is from 0.5 percent by weight to 2.5 percent by weight based upon the weight of the foundry aggregate.

15. A cold-box process for preparing a foundry shape comprising:
introducing the foundry mix of claim 10 into a pattern to form a foundry shape;
contacting the formed foundry shape with a vaporous curing catalyst capable of curing the shape until the formed foundry shape is sufficiently cured to be handleable; and
removing the formed and cured shape from the pattern.

16. A process for casting a metal part which comprises:
inserting a foundry shape prepared by the process of claim 15 into a mold assembly;
pouring metal, while in the liquid state, into said mold assembly;
allowing said metal to cool and solidify; and
then separating the cast metal part from the mold assembly.

17. A no-bake process for preparing a foundry shape comprising:
introducing a foundry mix of claim 13 into a pattern to form a foundry shape:
allowing the formed foundry shape to cure until said shape becomes handleable; and
removing the formed and cured foundry shape from the pattern.

18. A process for casting a metal part which comprises:
inserting a foundry shape prepared by the process of claim 17 into a mold assembly;
pouring metal, while in the liquid state, into said mold assembly;
allowing said metal to cool and solidify; and
then separating the cast metal part from the mold assembly.

19. A warm-box process for preparing a foundry shape comprising:
introducing a foundry mix of claim 13 into a pattern to form a foundry shape:
heating the formed foundry shape to a temperature from 150° C. to 260° C., until the formed foundry shape is sufficiently cured to be handleable; and
removing the formed and cured foundry shape from the pattern.

20. A process for casting a metal part which comprises:
inserting a foundry shape prepared by the process of claim 19 into a mold assembly;
pouring metal, while in the liquid state, into said mold assembly;
allowing said metal to cool and solidify; and
then separating the cast metal part from the mold assembly.

* * * * *